US005932628A

United States Patent [19]

Kiuchi et al.

[11] Patent Number: 5,932,628

[45] Date of Patent: Aug. 3, 1999

[54] BINDER COMPOSITION FOR PRODUCTION OF MOLDS AND METHOD OF PRODUCING MOLD

[75] Inventors: Kazuhiko Kiuchi; Masayuki Kato; Masuo Sawa; Shigeo Nakai, all of Toyohashi, Japan

[73] Assignee: Kao Corporation, Tokyo, Japan

[21] Appl. No.: 08/793,150

[22] PCT Filed: Aug. 17, 1995

[86] PCT No.: PCT/JP95/01633

§ 371 Date: Feb. 19, 1997

§ 102(e) Date: Feb. 19, 1997

[87] PCT Pub. No.: WO96/05925

PCT Pub. Date: Feb. 29, 1996

[30] Foreign Application Priority Data

Aug. 19, 1994 [JP] Japan ..... 6-218101
Aug. 19, 1994 [JP] Japan ..... 6-218102

[51] Int. Cl.[6] ..... B22C 1/22

[52] U.S. Cl. ..... 523/139; 528/232; 524/592

[58] Field of Search ..... 523/139; 524/592; 528/232

[56] References Cited

U.S. PATENT DOCUMENTS 4,017,461 4/1977 Dunlop et al. ..... 528/249
4,634,723 1/1987 Gardziella et al. ..... 523/144
4,636,537 1/1987 Gruber et al. ..... 523/139
5,288,774 2/1994 Gardziella et al. ..... 524/74
5,616,631 4/1997 Kiuchi et al. ..... 523/139

FOREIGN PATENT DOCUMENTS 391543 2/1939 Japan .
1387628 3/1975 United Kingdom .

OTHER PUBLICATIONS

Database WPI, XP002050933, Section Ch, Week 8432, Derwent Publications Ltd., London, GB; Class A21, AN 84–198587.

*Primary Examiner*—Kriellion S. Morgan
*Attorney, Agent, or Firm*—Birch, Stewart, Kolasch & Birch, LLP

[57] ABSTRACT

The binder composition for the production of molds of the present invention comprises a binder obtained by polycondensation of polycondensable components comprising as major components furfuryl alcohol, urea, and an aldehyde. In the binder contained in the binder composition for the production of molds, the difference [A–B] between the weight % of charged furfuryl alcohol (A) based on the weight of the binder and the weight % of unreacted furfuryl alcohol (B) based on the weight of the binder is 5.0 to 60.0. When the binder composition for the production of molds of the present invention is used, the curing of the binder is further accelerated without deteriorating the working atmosphere.

10 Claims, No Drawings

BINDER COMPOSITION FOR PRODUCTION OF MOLDS AND METHOD OF PRODUCING MOLD

TECHNICAL FIELD

The present invention relates to a binder composition for the production of molds which is used to be added to a refractory granular material when a mold is produced, and a (binder/curing agent for the production of molds) composition comprising a binder composition for the production of molds and a curing agent composition. The present invention also relates to a sand composition for the production of molds which comprises a refractory granular material and the binder composition for the production of molds, or a sand composition for the production of molds which comprises a refractry granular material, the binder composition for the production of molds and the curing agent composition. The present invention further relates to a method for producing a mold by using the sand composition for the production of molds.

BACKGROUND ART

Conventionally, as a binder for foundry sand for the production of molds, an acid curing resin, such as a phenolic resin, a furan resin, and furfuryl alcohol, is used, and a method of producing a mold wherein these binders are cured by adding a curing agent thereto is usually carried out. A furan resin having good properties as an organic self-curing resin for foundry sand has long been used (Japanese Patent Publication No. 39-1543/1964, etc.), and such a furan resin has been improved in various ways to develop, depending on its application, for example, a binder which is weaken in odor by adding thereto glyoxal, tetraoxane or the like and a binder is lowered in cost by modifying it with a phenolic resin, a urea resin or the like.

However, there has recently been a demand for an improvement in working efficiency through improvements in machinery, facilities, processes, and the like for the production of castings and in association with it, as a binder for foundry sand, a self-curing organic binder of a quick curing type has been strongly desired. To meet the demand, for example, a method wherein the sand temperature is elevated in order to accelerate the curing of a binder, a method wherein water is removed under reduced pressure, and a method wherein use is made of a large quantity of a curing agent have been adopted.

However, for such a purpose, to elevate the temperature is economically disadvantageous because extra energy is required. Further to remove water under reduced pressure can accelerate the curing to a certain extent but cannot fundamentally solve the problem. Further the use of a large quantity of a curing agent can improve the curing speed to accelerate the curing, but results in such disadvantages that the working atmosphere is deteriorated by the decomposed gases and that the strength of castings was lowered.

In view of the above, as a curing agent composition that makes the working atmosphere difficultly deteriorated even if the curing agent composition is used in a relatively large quantity, one wherein a phosphoric acid compound and a sulfonic acid compound are mixed in a specified ratio is suggested (Japanese Patent Application Laid-Open No. 5-237587). That is, by mixing a phosphoric acid compound low in toxicity with a sulfonic acid compound capable of promoting curing in a specified ratio, it is intended to accelerate the curing speed and to prevent the working atmosphere from being deteriorated. Although such a curing agent composition was very useful, it is needless to say that if the usage was too much, the working atmosphere was deteriorated disadvantageously. Further the above official gazette does not describe at all the use of a furan resin together with a curing accelerator and the adjustment of the degree of polycondensation of that furan resin.

DISCLOSURE OF THE INVENTION

Therefore, an object of the present invention is to provide a binder composition for the production of molds which does not deteriorate the working atmosphere and whose curing is promoted.

Further, an object of the present invention is to provide a (binder/curing agent for the production of molds) composition comprising the binder composition for the production of molds and a curing agent composition.

Still another object of the present invention is to provide a sand composition for the production of molds which comprises a refractory granular material and the binder composition for the production of molds, or a sand composition for the production of molds which comprises a refractry granular material, the binder composition for the production of molds and the curing agent composition.

Still another object of the present invention is to provide a method for producing a mold by using the sand composition for the production of molds.

The inventors of the present invention have studied keenly to attain the above objects and have found that, in a binder composition for the production of molds which comprises a binder obtained by polycondensation of polycondensable components comprising as a major component furfuryl alcohol, by adjusting the degree of polycondensation of the binder to a specified range, the curing of the binder composition for the production of molds can be further accelerated without deteriorating the working atmosphere.

Further, the inventors of the present invention have found that, in a binder composition for the production of molds which comprises a binder obtained by polycondensation of polycondensable components comprising as major components furfuryl alcohol, urea, and an aldehyde, by adjusting the degree of polycondensation of the binder to a specified range, by adjusting the water content in the binder composition for the production of molds to a specified value or below, and by adjusting the nitrogen atom content attributed to the urea in the binder composition for the production of molds, the curing of the binder composition for the production of molds can be further accelerated without deteriorating the working atmosphere.

The present invention has been made on the basis of the above findings to attain the above objects by providing a self-curing binder composition for the production of molds (hereinafter referred to as "a first binder composition for the production of molds") comprising a binder obtained by polycondensation of polycondensable components comprising as a major component furfuryl alcohol, and one or more curing accelerators represented by the following general formula (1):

(1)

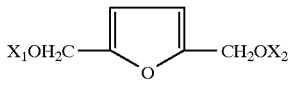

(wherein $X_1$ and $X_2$, which may be the same or different, each represent H, $CH_3$ or $C_2H_5$), wherein, in the binder contained in the binder composition for the production of molds, the difference [A–B] between the weight % of charged furfuryl alcohol (A) based on the weight of the binder and the weight % of unreacted furfuryl alcohol (B) based on the weight of the binder after the polycondensation is 5.0 to 60.0, and the curing accelerator is contained in an amount of 0.5 to 63.0% by weight.

Further, the present invention has also attained the above objects by providing a self-curing binder composition for the production of molds (hereinafter referred to as "a second binder composition for the production of molds") comprising a binder obtained by polycondensation of polycondensable components comprising as major components furfuryl alcohol, urea, and an aldehyde, wherein, in the binder contained in the binder composition, the difference [A–B] between the weight % of charged furfuryl alcohol (A) based on the weight of the binder and the weight % of unreacted furfuryl alcohol (B) based on the weight of the binder after the polycondensation is 5.0 to 60.0, the water content in the binder composition for the production of molds is 6.0% by weight or less, and the nitrogen atom content in the binder composition for the production of molds is 0.5 to 4.0% by weight. Preferably the polycondensable components comprise furfuryl alcohol and urea. It is also preferable that the polycondensable components comprise furfuryl alcohol and an aldehyde. Particularly preferably the polycondensable components comprise furfuryl alcohol, urea, and an aldehyde.

As the aldehyde, a conventionally known aldehyde compound can be used, such as formaldehyde, glyoxal, and furfural. In particular, in the present invention, formaldehyde is preferably used in view of the economy and odor.

When the polycondensation is carried out using as the polycondensable components furfuryl alcohol and/or urea and/or an aldehyde, a mixture (binder) comprising a condensate of furfuryl alcohol, a polycondensate of furfuryl alcohol and an alkylol urea, a condensate of urea and an aldehyde, a polycondensate formed by polycondensation of these condensates, unreacted reactants of the respective components, water, etc. is obtained, which will be varied depending on the mixing proportion of the components.

Preferably the binder is contained in an amount of 37.0 to 99.5% by weight in the first binder composition for the production of molds.

The mixing ratio and polycondensation conditions of the polycondensable components are suitably adjusted so that [A–B] may be within the above range. For example, if the binder is prepared by using polycondensable components made up of furfuryl alcohol, urea, and an aldehyde, they are preferably mixed in amounts of 50.0 to 98.0% by weight, 1.0 to 9.0% by weight, and 0.5 to 9.0% by weight respectively, subsequently they are reacted for a prescribed time under basic conditions, and then they are subjected to polycondensation under acid conditions.

An important point in the present invention is that the degree of polycondensation of furfuryl alcohol in the binder is adjusted to a specified range. Since it is difficult, however, to measure the degree of polycondensation of furfuryl alcohol directly, in the present invention, the difference between the weight % of charged furfuryl alcohol based on the weight of the binder and the weight % of unreacted furfuryl alcohol based on the weight of the binder after the polycondensation is taken as an index of the degree of polycondensation of furfuryl alcohol. That is, in the present invention, the degree of polycondensation of furfuryl alcohol is adjusted so that the difference, [A–B], between the weight % of charged furfuryl alcohol (A) and the weight % of unreacted furfuryl alcohol (B) after the polycondensation will be 5.0 to 60.0. If the difference [A–B] is less than 5.0, the degree of polycondensation of furfuryl alcohol is too low to increase satisfactorily the curing speed of the first binder composition for the production of molds and therefore the initial strength of the resulting mold is not improved. On the other hand, if the difference [A–B] is more than 60.0, the degree of polycondensation of furfuryl alcohol is too high and therefore the viscosity of the first binder composition for the production of molds is increased, which lowers the mixing capability of the below-described sand composition (mixed sand) for the production of molds, resulting in the lowering of the strength of the mold. The difference [A–B] is preferably 10.0 to 50.0, and more preferably 15.0 to 40.0.

To obtain an index of the degree of polycondensation of furfuryl alcohol, the weight % of charged furfuryl alcohol and the weight % of unreacted furfuryl alcohol must be measured and the measurement can be carried out, for example, by the following method.

In the above binder contained in the first binder composition for the production of molds, the weight % of unreacted furfuryl alcohol based on the weight of the binder after the polycondensation can be measured by gas chromatography. In that case the conditions of gas chromatography are as follows; the apparatus to be used: GC-14A manufactured by Shimadzu Corporation; the column to be used: PEG-20M chromosorb WAW DMCS 10% 60/80 MESH 0.5 m×3 mm (ϕ); the detector: FID; and the carrier gas: He.

Further, in the first binder composition for the production of molds, the method of measuring the weight % of charged furfuryl alcohol based on the weight of the binder is as follows. By allowing the reaction of potassium bromide, potassium bromate, and hydrochloric acid to produce bromine in excess to the furfuryl alcohol in the binder contained in the first binder composition for the production of molds, the produced bromine is added to the double bonds of the furfuryl alcohol, thereafter potassium iodide is added in excess to the excess bromine remaining in the system to produce iodine and potassium iodide, and the produced iodine is titrated with sodium thiosulfate to measure the weight % of charged furfuryl alcohol in the binder contained in the first binder composition for the production of molds. In this method of measuring charged furfuryl alcohol, detected aromatic compounds and aliphatic compounds having the double bonds in the molecules are measured separately by other method to calculate the weight % of charged furfuryl alcohol in the binder contained in the first binder composition for the production of molds.

The first binder composition for the production of molds of the present invention comprises a binder which is obtained by polycondensation of polycondensable components comprising as a major component furfuryl alcohol and has a degree of polycondensation in a specified range adjusted in the above manner, and one or more curing accelerators represented by the above general formula (1). As the curing accelerator, for example, 2,5-bishydroxymethylfuran, 2,5-bismethoxymethylfuran, 2,5-bisethoxymethylfuran, 2-hydroxymethyl-5-methoxymethylfuran, 2-hydroxymethyl-5-ethoxymethylfuran, and 2-methoxymethyl-5-ethoxymethylfuran can be mentioned, which can be used singly or as a mixture. Particularly, as the curing accelerator, 2,5-bishydroxymethylfuran is preferably used. This is because, in comparison with 2,5-bismethoxymethylfuran and 2,5-bisethoxymethylfuran, 2,5-bishydroxymethylfuran is high in reactivity to further accelerate the curing reaction of the binder obtained by polycondensation of the polycondensable components comprising as a major component furfuryl alcohol. The reason why 2,5-bishydroxymethylfuran is high in reactivity is that the hydroxyl groups in the molecule contribute to the curing reaction. In contrast, in the case where 2,5-bismethoxymethylfuran or the like is used, since it contributes to the curing reaction after the methoxymethyl ether is hydrolyzed to produce hydroxyl groups, the action of promoting the curing reaction becomes a little poor. In the case where furfuryl alcohol is reacted with formaldehyde to produce a furan resin, it is known that 2,5-bishydroxymethylfuran is produced as an initial condensate (see "Kobunshi Yakuzai Nyumon" published by Sanyo Chemical Industries, Ltd.). However, it has not been known that 2,5-bishydroxymethylfuran plays an action of promoting curing a binder obtained by polycondensation of polycondensable components comprising as a major component furfuryl alcohol.

The curing accelerator is added and contained in the first binder composition for the production of molds in an amount of 0.5 to 63.0% by weight. If the amount of the added curing accelerator is less than 0.5% by weight, the curing reaction of the first binder composition for the production of molds is not accelerated satisfactorily to improve the initial strength of the mold to a satisfactory extent. On the other hand, if the amount of the added curing accelerator is more than 63.0% by weight, the amount of the binder obtained by polycondensation of polycondensable components comprising as a major component furfuryl alcohol is relatively reduced whereby causing the curing accelerator to be difficultly dissolved in the binder and as a result a precipitation is produced in the first binder composition for the production of molds. The amount of the curing accelerator to be added is preferably 1.8 to 50.0% by weight, more preferably 2.5 to 50.0% by weight, further more preferably 5.0 to 40.0% by weight, and most preferably 7.0 to 40.0% by weight.

The water content in the first binder composition for the production of molds is preferably 6.0% by weight or less. The water content is more preferably 4.0% by weight or less, and most preferably 2.0% by weight or less. Since the first binder composition for the production of molds is cured by a dehydration condensation reaction, if the water content is more than 6.0% by weight, the progress of the dehydration condensation reaction is retarded to lower the curing speed of the first binder composition for the production of molds, and the initial strength of the mold is tend to be unfavorably lowered. Accordingly, from the point of view of the curing speed, the smaller the water content is, the more preferable it is. However, if the water content is too small, the viscosity of the first binder composition for the production of molds is increased excessively in some cases and sometimes it becomes difficult to handle. Therefore, in such a case, it is preferable that a small amount (that is, 6.0% by weight or less) of water should be contained in the first binder composition for the production of molds. To adjust the water content in the first binder composition for the production of molds, for example, water may be added subsequently to the obtained first binder composition for the production of molds, or alternatively, use may be made of the condensed water which is generated in the course of the production of the first binder composition for the production of molds, and if the content of the condensed water is excessive, the water may be removed by means of dehydration under reduced pressure or the like while if the content of the condensed water is too low, water may be added subsequently. The content (in % by weight) of water of the first binder composition for the production of molds is measured by the Karl Fischer's method.

If a nitrogen-atom-containing compound (generally urea) is used as the polycondensable component in addition to furfuryl alcohol, the nitrogen atom content attributed to the nitrogen-atom-containing compound in the binder composition for the production of molds is preferably 0.5 to 4.0% by weight. If the nitrogen atom content is less than 0.5% by weight, the amount of the urea used in the polycondensation of the polycondensable component is too small and therefore the strength of the resulting mold is not apt to improve satisfactorily while if the nitrogen atom content is more than 4.0% by weight, a gas attributed to nitrogen atoms is evolved at the time of pouring and therefore casting defects, such as pinholes, are apt to be unfavorably formed in the obtained casting. More preferably the above nitrogen atom content is 0.5 to 3.0% by weight, and most preferably 0.5 to 2.0% by weight.

Many of nitrogen atoms in the first binder composition for the production of molds are attributed to urea and even if other nitrogen-atom-containing compound than urea is used in obtaining the binder, the nitrogen atom content in the first binder composition for the production of molds is preferably adjusted to 0.5 to 4.0% by weight. The nitrogen atom content (in % by weight) is measured by the Kjeldahl method.

In the first binder composition for the production of molds, a binder obtained by polycondensation of polycondensable components comprising as a major component furfuryl alcohol is used as described above, and in particular a binder obtained by polycondensation of polycondensable components comprising furfuryl alcohol, urea, and an aldehyde is preferably used. In addition to these polycondensable components, at least one or more of conventionally known various modifiers may be mixed to prepare the binder. As those conventionally known various modifiers, can be used, for example, polymers and oligomers, such as phenolic resins, melamine resins, cumarone/indene resins, petroleum resins, polyesters, alkyd resins, polyvinyl alcohols, epoxy resins, ethylene/vinyl acetate, polyvinyl acetates, polybutadiene, polyethers, polyethyleneimines, polyvinyl chlorides, polyacrylates, polyvinyl butyrals, phenoxy resins, cellulose acetate, xylene resins, toluene resins, polyamides, styrene resins, polyvinyl formals, acrylic resins, urethane resins, and nylons; natural substances, such as lignin, lignin sulfonic acids, rosins, ester gums, vegetable oils, bitumens, fuel oils, cashew nut shell liquid, and vanillin; saccharides and their derivatives, such as starches, corn starch, glucose, and dextrins; polyhydric alcohols, such as resorcin, resorcin residue, cresol residue, a reaction by-product between 2,2,4-trimethyl-4(hydroxyphenyl) cumarone and isopropenylphenol, a reaction by-product between terephthalic acid and ethylene glycol, and polyethylene glycols; ketones, such as acetone, cyclohexane and acetophenone; condensates of these ketones with aldehydes; amino and imino compounds, such as dicyandiamide, acrylamide, and thiourea; condensates of these amino or imino compounds with aldehydes; and ester compounds, such as isocyanuric acid esters and unsaturated fatty acid esters. When these modifiers are additionally used together with the above-described polycondensable components, the amount thereof to be added is preferably 20% by weight or less based on the total weight of the above first binder composition for the production of molds.

In the first binder composition for the production of molds, in addition to the binder and curing accelerator, a silane coupling agent may be added as an optional component. As the silane coupling agent, for example, γ-(2-amino) aminopropylmethyldimethoxysilane, γ-aminopropyltrimethoxysilane, γ-aminopropyltriethoxysilane, γ-glycidoxypropyltrimethoxysilane, or the like can be preferably added in an amount of 0.03 to 1.0% by weight in the total amount of the composition.

Next, the second binder composition for the production of molds is described.

As described above, the second binder composition for the production of molds comprises a binder obtained by polycondensation of polycondensable components comprising as major components furfuryl alcohol, urea, and an aldehyde, wherein, in the binder contained in the binder composition for the production of molds, the difference [A−B] between the weight % of charged furfuryl alcohol (A) based on the weight of the binder and the weight % of unreacted furfuryl alcohol (B) based on the weight of the binder after the polycondensation is 5.0 to 60.0, the water content in the binder composition for the production of molds is 6.0% by weight or less, and the nitrogen atom content in the binder composition for the production of molds is 0.5 to 4.0% by weight.

As the aldehyde in the polycondensable components, the same aldehydes as those which are used in the first binder composition for the production of molds can be used.

An important point in the second binder composition for the production of molds is that, similarly to the first binder composition for the production of molds, the degree of polycondensation of furfuryl alcohol in the binder is adjusted to a specified range. Moreover, in the case of the second binder composition for the production of molds, since it is also difficult to measure directly the degree of polycondensation of furfuryl alcohol, similarly to the first binder composition for the production of molds, the difference between the weight % of charged furfuryl alcohol based on the weight of the binder and the weight % of unreacted furfuryl alcohol based on the weight of the binder after the polycondensation is taken as an index of the degree of polycondensation of furfuryl alcohol. That is, in the second binder composition for the production of molds, similarly to the first binder composition for the production of molds, the degree of polycondensation of furfuryl alcohol is adjusted so that the difference, [A−B], between the weight % of charged furfuryl alcohol (A) and the weight % of unreacted furfuryl alcohol (B) after the polycondensation will be 5.0 to 60.0. The reason why the difference [A−B] is specified to be in the range is the same as that of the case of the first binder composition for the production of molds. A preferable range of the above difference [A−B] is the same as that of the case of the first binder composition for the production of molds.

The method of measuring the weight % of charged furfuryl alcohol based on the weight of the binder and the weight % of unreacted furfuryl alcohol based on the weight of the binder is the same as that of the case of the first binder composition for the production of molds.

The water content in the second binder composition for the production of molds is needed to be 6.0% by weight or less. The water content is preferably 4.0% by weight or less, and most preferably 2.0% by weight or less. The reason why the water content is 6.0% by weight or less is the same as that of the first binder composition for the production of molds.

The methods for adjusting and measuring the water content in the second binder composition for the production of molds are the same as those of the first binder composition for the production of molds.

The nitrogen atom content (mainly attributed to urea but also inclusive of other nitrogen-atom-containing compounds than urea) in the second binder composition for the production of molds is needed to be 0.5 to 4.0% by weight. This reason is the same as that of the case of the first binder composition for the production of molds. The nitrogen atom content is preferably 0.5 to 3.0% by weight, and most preferably 0.5 to 2.0% by weight.

The nitrogen atom content (in % by weight) is measured by the Kjeldahl method in the same way as the case of the first binder composition for the production of molds.

In the second binder composition for the production of molds, in addition to the polycondensable components, one or more conventionally known various modifiers may be mixed to prepare the binder. As the conventionally known modifiers, the same as those of the case of the first binder composition for the production of molds can be used. Further the amount thereof to be added is the same as that of the case of the first binder composition for the production of molds.

The binder in the second binder composition for the production of molds is preferably contained in an amount of 40 to 100% by weight in the total amount of the composition.

Further, in the second binder composition for the production of molds, in addition to the binder and modifiers which is be used in the first binder composition for the production of molds, a silane coupling agent may be added as an optional component. As the silane coupling agent, for example, γ-(2-amino)aminopropylmethyldimethoxysilane, γ-aminopropyltrimethoxysilane, γ-aminopropyltriethoxysilane, γ-glycidoxypropyltrimethoxysilane, or the like can be preferably added in an amount of 0.03 to 1.0% by weight in the total amount of the composition.

Next, the (binder/curing agent for the production of molds) composition of the present invention will be described.

The (binder/curing agent for the production of molds) composition comprises the binder composition for the production of molds and a curing agent (or a curing agent composition).

As the curing agent, a conventionally known any curing agent which is used in the production of molds can be used. Particularly preferable one as the curing agent is a curing agent composition comprising a phosphoric acid type compound and a sulfonic acid type compound mixed in a specified ratio which is described in Japanese Patent Application Laid-Open No. 5-237587.

The curing agent composition will be further described. In the curing agent composition, the blending is carried out preferably in such a manner that the weight ratio of the phosphorus atom weight (phosphorus atom content) attributed to the phosphoric acid type compound to the sulfur atom weight (sulfur atom content) attributed to the sulfonic acid type compound satisfies the relation $0.01 \leqq$(the sulfur atom content/(the phosphorus atom content+the sulfur atom content))$\leqq 0.7$. In other words, the sulfur atom weight in the curing agent composition is preferably adjusted to 1/99 to 7/3 of the phosphorus atom weight. If the sulfur atom weight is smaller than the above range, the phosphorus atom weight becomes relatively excessive (that is, the amount of the phosphoric acid type compound becomes excessive), thereby phosphorus atoms are apt to accumulate in a large amount in the reclaimed sand that has used a refractory granular material repeatedly, leading to a tendency that casting defects, such as pinholes, are liable to be formed. Further, the phosphorus accumulated in the reclaimed sand absorbs moisture intensely, leading to a tendency to hamper the curing of the binder composition for the production of molds. On the other hand, if the sulfur atom weight is larger than the above range (that is, the amount of the sulfonic acid compound exceeds the prescribed range), harmful decomposition products are liable to be released at the time of pouring, leading to a tendency to deteriorate the working atmosphere. Most preferably the weight ratio of the phosphorus atom weight and the sulfur atom weight falls to 0.03≦(the sulfur atom content/(the phosphorus atom content+the sulfur atom content))≦0.6. The sulfur atom content in the curing agent composition is measured by the combustion-neutralization titration method and the phosphorus atom content in the above curing agent composition is measured by ICP (inductively coupled plasma emission spectrometer).

As the phosphoric acid type compound in the curing agent composition, for example, phosphoric acid, a polyphosphoric acid, an ester of phosphoric acid, such as methyl phosphate and ethyl phosphate, or a salt of phosphoric acid, such as potassium phosphate and potassium hydrogenphosphate, is used.

On the other hand, as the sulfonic acid type compound in the curing agent composition, for example, an aliphatic sulfonic acid, such as methanesulfonic acid and ethanesulfonic acid; an aromatic sulfonic acid, such as benzenesulfonic acid, toluenesulfonic acid, xylenesulfonic acid, and phenolsulfonic acid; or an inorganic acid, such as sulfuric acid, is used.

In the (binder/curing agent for the production of molds) composition, there are no particular restrictions on the mixing ratio (on the basis of weight) of the binder composition for the production of molds and the curing agent (or the curing agent composition), but generally the range of the mixing ratio is such that preferably the binder composition for the production of molds/the curing agent (or the curing agent composition) is from 1.0 to 20.0, and more preferably from 1.0 to 5.0.

In the (binder/curing agent for the production of molds) composition, in addition to the binder composition for the production of molds and the curing agent (or the curing agent composition), a silane coupling agent may be added as an optional component. As the silane coupling agent, for example, γ-(2-amino)aminopropylmethyldimethoxysilane, γ-aminopropyltrimethoxysilane, γ-aminopropyltriethoxysilane, γ-glycidoxypropyltrimethoxysilane, or the like can be added preferably in an amount of 0.03 to 1.0% by weight in the total amount of the composition.

Next, the sand composition for the production of molds will be described.

The sand composition for the production of molds comprises a refractory granular material and the binder composition for the production of molds or comprises a refractory granular material, the binder composition for the production of molds, and the curing agent (or the curing agent composition).

The sand composition for the production of molds can be obtained, for example, by kneading the binder composition for the production of molds into the refractory granular material or by kneading the binder composition for the production of molds and the curing agent (or the curing agent composition) into the refractory granular material.

As the refractory granular material, those conventionally known as foundry sand, for example, new sand, such as siliceous sand comprising quartzose material as a major component, chromite sand, zircon sand, olivine sand, alumina sand, mullite sand, and synthetic mullite sand, reclaimed sand, and the like can be used.

As the reclaimed sand, one obtained, for example, by the ordinal mechanical abrading technique or roasting technique can be used and one reclaimed by the abrading technique is preferable because the yield is high and it is economically excellent and is common.

In the sand composition for the production of molds, there are no particular restrictions on the mixing ratio of the refractory granular material, the binder composition for the production of molds, and the curing agent (or the curing agent composition), but generally the range is such that, based on the total amount of the composition, the refractory granular material is preferably contained in an amount of 90.0 to 99.99% by weight, the binder composition for the production of molds is preferably contained in an amount of 0. 1 to 5.0% by weight, and the curing agent (or the curing agent composition) is preferably contained in an amount of 0.005 to 5.0% by weight.

Further, to the sand composition for the production of molds, may be added, in addition to the essential components, a silane coupling agent for the purpose of further improving the strength of the resulting mold.

As the silane coupling agent, for example, γ-(2-amino) aminopropylmethyldimethoxysilane, γ-aminopropyltrimethoxysilane, γ-aminopropyltriethoxysilane, γ-glycidoxypropyltrimethoxysilane, or the like can be mentioned. The silane coupling agent can be added preferably in an amount of 0.00003 to 0.05% by weight in the total amount of the sand composition for the production of molds. The silane coupling agent may be contained previously in the binder composition for the production of molds.

Next, the method for producing a mold by using the sand composition for the production of molds of the present invention will be described.

According to the present invention, a mold can be produced using the sand composition for the production of molds generally by the method for producing a self-curing mold. That is, the method of the present invention comprises the steps of filling the sand composition for the production of molds into a prescribed molding pattern and curing the binder composition for the production of molds contained in sand composition for the production of molds by the action of the curing agent composition thereby obtaining a mold. According to the sand composition for the production of molds comprising the binder composition for the production of molds, the curing speed of the mold is relatively high and about 30 minutes to 1 hour after the filling of the sand composition for the production of molds into the molding pattern, the mold can be removed satisfactorily. In addition, pouring the molten metal into the mold can produce a high quality casting under a good atmosphere. In the kneading of the sand composition for the production of molds, in the production of molds, and in the curing, etc., heating or cooling is not particularly required and they are carried out at ambient temperatures without any trouble. Further, with respect to points that have not been particularly described in detail in the method of producing a mold, techniques for the conventionally known method of producing molds can be suitably applied.

EXAMPLES

Now, the present invention is described in detail by Examples, but the present invention is not limited to these Examples. The percentages quoted in the Examples and Comparative Examples represent % by weight.

(Examples 1 to 19 and Comparative Examples 1 to 8)

The polycondensable components made up of furfuryl alcohol, urea, and formaldehyde are reacted for a prescribed time under basic conditions and then are further reacted under acid conditions to effect polycondensation with dehydration being effected as required. After the completion of the polycondensation, the curing accelerator (2,5-furandimethanol (bishydroxymethylfuran) (1883-75-6) (CAS registered number) manufactured by Aldrich Fine Chemical Co., Ltd.) shown in Tables 1 and 2 is added, followed by mixing, to prepare each of the binder compositions for the production of molds wherein the curing accelerator is contained in the ratio (% by weight) shown in Tables 1 and 2 and the difference [A−B] between the weight % (A) of charged furfuryl alcohol and the weight % (B) of unreacted furfuryl alcohol is shown in Tables 1 and 2. In these binder compositions for the production of molds, the water content is 2.0% by weight and the nitrogen atom content is 2.0% by weight.

Then 1 part by weight of each of the binder compositions for the production of molds and 0.4 part by weight of a 70% aqueous toluenesulfonic acid solution as a curing agent are added to every 100 parts by weight of Kakezu floatation No. 5 siliceous sand as a refractory granular material, followed by mixing, to obtain sand compositions for the production of molds. Immediately thereafter, each of the sand compositions for the production of molds is filled into a test piece frame measuring 50 mm (ϕ)×50 mm (height) and test molds are obtained at 25° C. by the self-curing mold shaping method. At that time, after the passage of 1 hour and 24 hours, the compression strength of the test molds is measured by the method described in JIS Z 2604-1976. The results are shown in Tables 1 and 2.

TABLE 1

| | Curing Accelerator | | | Compression Strength ($kg/cm^2$) | |
|---|---|---|---|---|---|
| Examples | Type | Amount | [A−B] | After 1 hr | After 24 hrs |
| 1 | Bishydroxymethylfuran | 0.5 | 5.0 | 5.7 | 33.1 |
| 2 | Bishydroxymethylfuran | 2.0 | 5.2 | 6.6 | 33.6 |
| 3 | Bishydroxymethylfuran | 2.0 | 7.8 | 7.3 | 34.2 |
| 4 | Bishydroxymethylfuran | 3.0 | 7.8 | 7.9 | 34.5 |
| 5 | Bishydroxymethylfuran | 3.0 | 12.5 | 8.8 | 35.3 |
| 6 | Bishydroxymethylfuran | 6.0 | 12.5 | 9.7 | 35.8 |
| 7 | Bishydroxymethylfuran | 6.0 | 17.5 | 10.6 | 36.6 |
| 8 | Bishydroxymethylfuran | 8.0 | 17.5 | 11.6 | 37.0 |
| 9 | Bishydroxymethylfuran | 8.0 | 25.2 | 12.9 | 39.7 |
| 10 | Bishydroxymethylfuran | 8.0 | 35.6 | 12.4 | 38.3 |
| 11 | Bishydroxymethylfuran | 15.0 | 20.3 | 16.9 | 48.0 |
| 12 | Bishydroxymethylfuran | 25.0 | 26.6 | 20.3 | 53.2 |
| 13 | Bishydroxymethylfuran | 25.0 | 35.5 | 20.0 | 50.7 |
| 14 | Bishydroxymethylfuran | 25.0 | 42.5 | 14.1 | 45.6 |
| 15 | Bishydroxymethylfuran | 35.0 | 32.3 | 17.1 | 48.4 |

As is apparent from the results in Tables 1 and 2, it can be understood that, in the case where the binder compositions for the production of molds that contain a curing accelerator are used, the strength of the molds after the passage of 1 hour is increased and the strength of the molds after the passage of 24 hours is also increased. It can also understood that as the content of the curing accelerator is increased gradually from 0.5% by weight, the strength of the molds is also increased. It can be understood that in that case, at the point where the curing accelerator is contained in an amount of 25% by weight, the maximum value is attained, and as the curing accelerator is further increased, the strength of the molds is lowered gradually, and when the amount exceeds 63% by weight, the binder composition for the production of molds becomes nonuniform. Further, it can be understood that when the amount of the curing accelerator is made to be less than 0.5% by weight, the strength of the molds is not improved very much. On the other hand, it is understood that, in the binder contained in the binder composition for the production of molds, when the difference between the weight % of charged furfuryl alcohol (A) based on the weight of the binder and the weight % of unreacted furfuryl alcohol (B) based on the weight of the binder, that is, the value of [A−B], is in the range of 5.0 to 60.0, then after the passage of 1 hour, the strength of the molds is increased, and also after the passage of 24 hours, the strength of the molds is also increased. Further it is understood that as the value of the difference [A−B] is increased gradually from 5.0, the strength of the molds is also increased gradually. It can be understood that, in that case, when the difference [A−B] is from 15.0 to around 40.0, the maximum value is attained, then, when the difference [A−B] is further increased, the strength of the molds is decreased gradually, and when the difference [A−B] is more than 60.0, the strength of the molds is decreased. On the other hand, it can be understood that also in the case where the difference [A−B] is less than 0.5, the strength of the molds is apt to decrease.

(Examples 20 to 33)

The polycondensable components made up of furfuryl alcohol, urea, and formaldehyde are polycondensed to obtain binders wherein the difference between the weight % of charged furfuryl alcohol (A) and the weight % of unreacted furfuryl alcohol (B), that is, [A−B], is 25.0. Further, to the binders, a curing accelerator comprising 2,5-bishydroxymethylfuran is added, followed by mixing, thereby obtaining the binder compositions for the production

TABLE 2

| | | Curing Accelerator | | | Compression Strength ($kg/cm^2$) | |
|---|---|---|---|---|---|---|
| | | Type | Amount | [A−B] | After 1 hr | After 24 hrs |
| Examples | 16 | Bishydroxymethylfuran | 45.0 | 32.6 | 14.0 | 45.4 |
| | 17 | Bishydroxymethylfuran | 55.0 | 47.1 | 13.9 | 41.3 |
| | 18 | Bishydroxymethylfuran | 63.0 | 52.2 | 13.0 | 40.8 |
| | 19 | Bishydroxymethylfuran | 15.0 | | | |
| | | | | 20.5 | 17.1 | 48.6 |
| | | Bismethoxymethylfuran | 1.0 | | | |
| Comparative Example | 1 | None | | 3.0 | 2.6 | 28.0 |
| | 2 | Bishydroxymethylfuran | 0.3 | 1.8 | 2.8 | 29.2 |
| | 3 | Bishydroxymethylfuran | 0.3 | 6.5 | 3.6 | 29.5 |
| | 4 | Bishydroxymethylfuran | 2.1 | 3.5 | 3.8 | 29.8 |
| | 5 | Bishydroxymethylfuran | 30.8 | 65.2 | 2.8 | 29.6 |
| | 6 | Bishydroxymethylfuran | 50.3 | 65.6 | 3.0 | 29.8 |
| | 7 | Bishydroxymethylfuran | 64.5 | 58.0 | *1 | |
| | 8 | Bishydroxymethylfuran | 65.0 | 63.5 | *1 | |

*1 The measurement could not be conducted since the test mold was not homogeneous.

of molds each of which has the water content and the nitrogen atom content shown in Table 3. All the contents of the curing accelerators in the binder compositions for the production of molds shown in Table 3 are 15% by weight.

Test molds are produced in the same way as in Example 1, except for using these binder compositions for the production of molds. Then the compression strength of these molds is measured in the same way as in Example 1. The results are shown in Table 3.

TABLE 3

| | In binder composition for production of molds (wt %) | | Compression Strength (kg/cm$^2$) | |
|---|---|---|---|---|
| Examples | Water content | Nitrogen atom content | After 1 hr | After 24 hrs |
| 20 | 1.2 | 2.5 | 21.4 | 51.5 |
| 21 | 3.8 | 2.5 | 18.1 | 47.9 |
| 22 | 4.3 | 2.5 | 16.0 | 43.3 |
| 23 | 5.7 | 2.5 | 13.2 | 40.1 |
| 24 | 3.8 | 0.6 | 12.4 | 37.8 |
| 25 | 3.8 | 1.8 | 15.2 | 42.0 |
| 26 | 3.8 | 2.8 | 14.8 | 44.5 |
| 27 | 3.8 | 3.2 | 14.5 | 41.3 |
| 28 | 3.8 | 3.9 | 13.0 | 38.7 |
| 29 | 6.2 | 2.5 | 9.0 | 33.8 |
| 30 | 8.5 | 2.5 | 6.2 | 31.5 |
| 31 | 3.8 | 0.4 | 8.2 | 34.2 |
| 32 | 3.8 | 4.2 | 9.1 | 35.1 |
| 33 | 3.8 | 5.0 | 7.7 | 33.0 |

As is apparent from the results in Table 3, it can be understood that when the water content is decreased gradually from 6.0% by weight, the strength of the molds is also gradually decreased. It can also be understood that when the nitrogen atom content is decreased gradually from 4.0% by weight, the strength of the molds is increased gradually. It can be understood that, in that case, when the nitrogen atom content is around 1.0 to 3.0% by weight, the strength of the molds attains the maximum value, while when the nitrogen atom content is decreased further, the strength of the molds is decreased gradually, and when the nitrogen atom content is less than 0.5% by weight, the strength of the molds is also decreased. On the other hand, it can be understood that in the case wherein the nitrogen atom content is more than 4.0% by weight, the strength of the molds is decreased.

(Examples 34 to 45 and Comparative Examples 9 to 14)

The polycondensable components made up of furfuryl alcohol, urea, and formaldehyde are polycondensed to obtain binder compositions for the production of molds containing a binder wherein the difference between the weight % of charged furfuryl alcohol (A) and the weight % of unreacted furfuryl alcohol (B), that is, [A−B], is 30.0. The water contents and the nitrogen atom contents in these binder compositions for the production of molds are as shown in Table 4 (18 kinds).

On the other hand, as a curing agent composition, one obtained by mixing a 70% aqueous toluenesulfonic acid and 85% phosphoric acid in equal amounts, that is, one wherein the (the sulfur atom content/(the phosphorus atom content+ the sulfur atom content)) is 0.326, is prepared.

Then, to every 100 parts by weight of Kakezu floatation No. 5 siliceous sand as a refractory granular material, are added 1 part by weight of each of the binder compositions for the production of molds and 0.45 part by weight of the curing agent composition followed by mixing, thereby obtaining sand compositions for the production of molds. Test molds are produced in the same way as in Example 1, except for using these sand compositions for the production of molds. Then the compression strength of these molds is measured in the same way as in Example 1.

The results are shown in Table 4.

TABLE 4

| | | In binder composition for production of molds (wt %) | | Compression Strength (kg/cm$^2$) | |
|---|---|---|---|---|---|
| | | Water content | Nitrogen atom content | After 1 hr | After 24 hrs |
| Examples | 34 | 6.0 | 2.5 | 6.3 | 43.6 |
| | 35 | 4.2 | 2.5 | 7.5 | 45.3 |
| | 36 | 3.1 | 2.5 | 9.0 | 47.0 |
| | 37 | 2.3 | 2.5 | 10.6 | 48.7 |
| | 38 | 1.5 | 2.5 | 12.5 | 49.5 |
| | 39 | 0.6 | 2.5 | 13.2 | 50.8 |
| | 40 | 3.5 | 4.0 | 7.6 | 45.5 |
| | 41 | 3.5 | 3.2 | 7.8 | 46.8 |
| | 42 | 3.5 | 2.6 | 8.0 | 47.4 |
| | 43 | 3.5 | 2.1 | 8.1 | 46.5 |
| | 44 | 3.5 | 1.2 | 8.0 | 46.4 |
| | 45 | 3.5 | 0.5 | 6.8 | 42.9 |
| Comparative Examples | 9 | 6.4 | 2.5 | 4.2 | 37.7 |
| | 10 | 9.0 | 2.5 | 2.1 | 32.4 |
| | 11 | 3.5 | 5.2 | 3.8 | 35.6 |
| | 12 | 3.5 | 4.4 | 4.7 | 38.1 |
| | 13 | 3.5 | 0.3 | 4.2 | 37.5 |
| | 14 | 3.5 | 0.2 | 3.3 | 34.0 |

As is apparent from the results in Table 4, it can be understood that when the water content in the binder compositions for the production of molds is decreased gradually from 6.0% by weight, the strength of the molds is also increased gradually. It can also be understood that when the nitrogen atom content is decreased gradually from 4.0% by weight, the strength of the molds is increased gradually. It can be understood that, in that case, when nitrogen atom content is around 1.0 to 2.0% by weight, the strength of the mold attains the maximum value, then when the nitrogen atom content is decreased gradually, the strength of the molds is decreased gradually, and when the nitrogen atom content is made to be less than 0.5% by weight, the strength of the molds is decreased. On the other hand, it can be understood that in the case wherein the nitrogen atom content is more than 4.0% by weight, the strength of the mold is also decreased.

(Examples 46 to 53)

As curing agent compositions, those containing the components shown in Table 5 are prepared. A component other than shown in Table 5 is water.

On the other hand, polycondensable components made up of furfuryl alcohol, urea, and formaldehyde are polycondensed to obtain a binder wherein the difference between the weight % of charged furfuryl alcohol (A) and the weight % of unreacted furfuryl alcohol (B), that is, [A−B], is 25.0. To the binder, is added a curing accelerator made of 2,5-bishydroxymethylfuran, followed by mixing, thereby preparing a binder composition for the production of molds wherein the water content is 2.0% by weight and the nitrogen atom content is 2.0% by weight. The binder composition for the production of molds contains the curing accelerator in an amount of 15.0% by weight.

To every 100 parts by weight of silicious sand is added 0.33 part by weight of each of the curing agent compositions shown in Table 5, followed by mixing, and then 0.65 part by weight of the above binder composition for the production of molds is added, followed by mixing, thereby obtaining sand compositions for the production of molds. After these sand compositions for the production of molds are used to produce molds to make castings wherein the weight ratio of the mold/molten metal is 2.5, the sands recovered by disintegrating the molds are subjected to an operation by a crusher to obtain reclaimed sands using an M type rotary reclaimer manufactured by Japan Casting Co., Ltd.

After 95 parts by weight of each of these reclaimed sands and 5 parts by weight of new sand are mixed, the curing agent composition and the binder composition for the production of molds are added thereto in the same ratio as the above, followed by mixing, to repeat the production of molds, casting, reclaiming of the sand, and cycling of the reclaimed sand 20 times, then to each of the last reclaimed sands are added the curing agent composition and the binder composition for the production of molds in the same ratio as the above, followed by mixing, and molds are molded therefrom. Then the mold is produced, and after the passage of 0.5 hour, 1 hour, and 24 hours, the compression strength of the mold is measured. Further, with respect to the moisture absorption of the reclaimed sands, after the reclaimed sands obtained after the 20th cycle are allowed to stand for 24 hours in an atmosphere having 90% RH at 25° C., the moisture absorption of the reclaimed sands is measured. Further, the measurement of the amount of $SO_2$ released at the time of the 20th casting is carried out under the following severe conditions: immediately after the completion of filling a molten metal into a mold of 620 mm×770 mm×530 mm (height) to mold a casting with a casting/molten metal weight ratio of 2.5, the mold is covered with a wood box of 900 mm×900 mm×900 mm (height), and 5 minutes after the completion of the casting, $SO_2$ is measured from the upper part of the box by a defection tube. The results are shown in Table 6.

TABLE 5

| | Curing agent composition | | | | Atom content in curing agent composition | | (I)/ |
|---|---|---|---|---|---|---|---|
| | Sulfonic acid compound | | Phosphoric acid compound | | (I) | (II) | [(I) |
| Examples | Type | Amount (%) | Type | Amount (%) | Sulfur atom | Phosphorus atom | + (II)] |
| 46 | Methanesulfonic acid | 2.7 | 85% phosphoric acid | 24.9 | | | |
| | Toluenesulfonic acid | 35.0 | | | 13.95 | 6.7 | 0.676 |
| | Sulfuric acid | 20.0 | | | | | |
| 47 | Ethanesulfonic acid | 2.0 | 85% phosphoric acid | 22.3 | | | |
| | Phenolsulfonic acid | 14.5 | Pyrophosphoric acid | 2.0 | 3.9 | 6.7 | 0.368 |
| | Benzenesulfonic acid | 3.2 | | | | | |
| 48 | Phenolsulfonic acid | 6.8 | 85% phosphoric acid | 44.7 | | | |
| | Toluenesulfonic acid | 38.6 | Methyl phosphate | 5.0 | 9.25 | 13.4 | 0.408 |
| | Xylenesulfonic acid | 4.8 | | | | | |
| 49 | Xylenesulfonic acid | 8.5 | 85% phosphoric acid | 47.9 | | | |
| | Phenolsulfonic acid | 7.8 | Sodium dihydrogenphosphate | 2.0 | 2.9 | 13.4 | 0.178 |
| 50 | Xylenesulfonic acid | 19.5 | 85% phosphoric acid | 65.9 | | | |
| | | | | | 5.8 | 18.5 | 0.239 |
| | Sulfuric acid | 7.5 | Metaphosphoric acid | 2.0 | | | |
| 51 | Benzenesulfonic acid | 1.0 | 85% phosphoric acid | 57.8 | | | |
| | Toluenesulfonic acid | 2.1 | Sodium dihydrogenphosphate | 2.0 | 0.6 | 16.0 | 0.036 |
| 52 | Tolnenesulfonic acid | 0.5 | Phosphorus pentoxide | 39.9 | | | |
| | | | | | 0.12 | 17.42 | 0.007 |
| | Sulfuric acid | 0.1 | | | | | |
| 53 | Benzenesulfonic acid | 48.5 | 85% phosphoric acid | 9.9 | | | |
| | Toluenesulfonic acid | 5.2 | | | 16.74 | 2.68 | 0.862 |
| | Sulfuric acid | 18.2 | | | | | |

Note:
(I)/[(I) + (II)] : [Sulfur atom content/(sulfur atom content + phosphorus atom content)] in the curing agent composition.

TABLE 6

| Examples | Moisture absorption of reclaimed sand (% based on sand) | Amount of released $SO_2$ (ppm) | Compression Strength ($kg/cm^2$) After 0.5 hr | After 1.0 hr | After 24 hrs | Test temperature of compression strength (° C.) |
|---|---|---|---|---|---|---|
| 46 | 0.21 | 72.3 | 3.3 | 9.9 | 44.8 | 5 |
| 47 | 0.25 | 21.8 | 5.4 | 10.2 | 43.9 | 35 |
| 48 | 0.23 | 47.8 | 3.6 | 9.3 | 45.7 | 5 |
| 49 | 0.27 | 16.1 | 5.7 | 11.0 | 41.4 | 35 |
| 50 | 0.25 | 28.3 | 5.9 | 10.9 | 44.1 | 5 |
| 51 | 0.27 | 3.9 | 5.8 | 10.2 | 42.5 | 35 |
| 52 | 0.44 | 1.2 | 0 | 0.7 | 12.7 | 35 |
| 53 | 0.18 | 102.5 | 2.0 | 8.8 | 41.0 | 5 |

As is apparent from the results in Tables 5 and 6, it can be understood that when the value of (the sulfur atom content/(the phosphorus atom content+the sulfur atom content)) is less than 0.01, the moisture absorption of the reclaimed sands is high and the compression strength is decreased. It can also be understood that when the value of (the sulfur atom content/(the phosphorus atom content+the sulfur atom content)) is more than 0.7, the working atmosphere is quite deteriorated. Accordingly, taking all the aspects together into consideration, it can be understood that, in the case wherein the curing agent compositions of Examples 46 to 51 are used, the moisture absorption of the reclaimed sands is less influenced, the compression strength is high, and the working atmosphere is good.

(Examples 54 to 61)

The binder compositions for the production of molds are prepared in the same manner as in the binder composition for the production of molds used in Example 34, except that the water content is made to be 0.3% by weight and the nitrogen atom content is made to be 2.5% by weight.

To every 100 parts by weight of siliceous sand, 0.33 part by weight of each of the curing agent compositions shown in Table 5 is added, followed by mixing, and then 0.65 part by weight of the binder composition for the production of molds is added, followed by mixing, thereby obtaining sand compositions for the production of molds. Examples 46 to 53 are repeated except for the above, thereby measuring the moisture absorption of the reclaimed sands, the amount of $SO_2$ released at the time of the casting, and the compression strength of the molds. The results are shown in Table 7.

As is apparent from the results in Tables 5 and 7, it can be understood that when the value of (the sulfur atom content/(the phosphorus atom content+the sulfur atom content)) is less than 0.01, the moisture absorption of the reclaimed sand is high and the compression strength is decreased. It can also be understood that when the value of (the sulfur atom content/(the phosphorus atom content+the sulfur atom content)) is more than 0.7, the working atmosphere is quite deteriorated. On the other hand, it can be understood that, in the case wherein the curing agent compositions of Examples 54 to 59 are used, the moisture absorption of the reclaimed sands is less influenced, the compression strength is high, and the working atmosphere is good.

(Examples 62 to 71 and Comparative Examples 15 to 17)

The binder compositions for the production of molds containing binders obtained by polycondensation of polycondensable components made up of furfuryl alcohol, urea, and formaldehyde are obtained. In the binder compositions for the production of molds, the water content is 0.8% by weight, the nitrogen atom content is 1.8% by weight, and the difference [A−B] between the weight % of charged furfuryl alcohol (A) and the weight % of unreacted furfuryl alcohol (B) is as shown in Table 8.

Test molds are produced in the same manner as in Example 34, except for using these binder compositions for the production of molds. After the passage of 1 hour and the passage of 24 hours, the compression strength of the molds is measured. The results are shown in Table 8.

TABLE 7

| Examples | Moisture absorption of reclaimed sand (% based on sand) | Amount of released $SO_2$ (ppm) | Compression Strength ($kg/cm^2$) After 0.5 hr | After 1.0 hr | After 24 hrs | Test temperature of compression strength (° C.) |
|---|---|---|---|---|---|---|
| 54 | 0.23 | 74.5 | 2.8 | 8.3 | 37.7 | 5 |
| 55 | 0.27 | 22.0 | 4.5 | 8.6 | 36.9 | 35 |
| 56 | 0.25 | 49.0 | 3.0 | 7.8 | 38.4 | 5 |
| 57 | 0.29 | 16.5 | 4.8 | 9.3 | 34.8 | 35 |
| 58 | 0.28 | 29.0 | 5.0 | 9.2 | 37.1 | 5 |
| 59 | 0.29 | 4.0 | 4.9 | 8.6 | 35.1 | 35 |
| 60 | 0.48 | 1.2 | 0 | 0.6 | 10.7 | 35 |
| 61 | 0.20 | 105.0 | 1.9 | 7.4 | 34.5 | 5 |

TABLE 8

| | In binder composition for production of molds | Compression Strength ($kg/cm^2$) | |
|---|---|---|---|
| | [A–B] | After 1 hr | After 24 hrs |
| Examples | | | |
| 62 | 5.0 | 6.0 | 42.3 |
| 63 | 7.8 | 6.4 | 43.1 |
| 64 | 10.4 | 7.8 | 44.8 |
| 65 | 12.7 | 10.7 | 45.4 |
| 66 | 15.6 | 13.2 | 46.5 |
| 67 | 23.1 | 13.5 | 48.0 |
| 68 | 30.5 | 13.3 | 46.8 |
| 69 | 43.0 | 10.5 | 45.7 |
| 70 | 52.7 | 8.3 | 45.1 |
| 71 | 60.0 | 6.1 | 43.5 |
| Comparative Examples | | | |
| 15 | 1.8 | 3.3 | 36.0 |
| 16 | 4.5 | 4.8 | 36.4 |
| 17 | 64.2 | 4.0 | 32.6 |

As is apparent from the results in Table 8, it can be understood that, in the above binders contained in the binder compositions for the production of molds, when the difference between the weight % of charged furfuryl alcohol (A) based on the weight of the binder and the weight % of unreacted furfuryl alcohol (B) based on the binder, that is, the value of [A–B], is in the range of 5.0 to 60.0, after the passage of 1 hour, the strength of the molds is increased and after the passage of 24 hours, the strength of the mold is also increased. Further it can be understood that when the value of the difference [A–B] is increased from 5.0 gradually, the strength of the molds is also increased gradually. It can be understood that, in that case, when the difference [A–B] is around 15.0 to 40.0, the maximum value is obtained, and when [A–B] is increased further, the strength of the molds is decreased gradually, and when it is more than 60.0, the strength of the molds is decreased. Further it can be understood that in the case wherein the difference [A–B] is less than 5.0, the strength of the molds is decreased.

INDUSTRIAL APPLICABILITY

When a mold is produced by using the binder composition for the production of the present invention, the curing speed of the binder is improved and a mold high in initial strength can be obtained. Therefore, when a mold is produced using the binder composition for the production of molds of the present invention by adopting the method for producing self-curing molds, an advanegeous effect that the mold can be removed from the molding block at an early stage and therefore that the molding pattern can be used effectively can be exhibited.

Further, in the binder composition for the production of molds of the present invention, by using a polycondensate of polycondensable components comprising furfuryl alcohol, urea, and an aldehyde, adjusting the water content in the binder composition for the production of molds to a specified value or below, or by adjusting the nitrogen atom content in the binder composition for the production of molds to a specified range, the curing of the binder composition for the production of molds can be further accelerated and therefore the above-described advantageous effect of the present invention can be further improved.

Further, by using a (binder/curing agent for the production of molds) composition comprising the binder composition for the production of molds of the present invention and a curing agent composition wherein the sulfur atom content and the phosphorus atom content are adjusted to specified ranges, even if reclaimed sand is used in a large quantity to produce a mold, the advantageous effects that toxic gases, such as $SO_2$, are less released and that a mold having high initial strength as well as high final strength can be obtained are exhibited.

It would be obvious to those skilled in the art that numerous changes and modifications of the present invention are possible without departing from the spirit and scope of the present invention. Accordingly, the above Examples are merely simple illustrations of the present invention and such changes and modifications should be embraced in the invention set forth in the accompanying claims.

We claim:

1. A self-curing binder composition for the production of molds comprising a binder obtained by polycondensation of polycondensable components comprising as a major component furfuryl alcohol, and one or more curing accelerators represented by the following general formula (1):

(1)

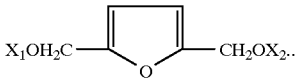

(wherein $X_1$ and $X_2$, which may be the same or different, each represent H, $CH_3$ or $C_2H_5$), wherein, in the binder contained in the binder composition for the production of molds, the difference between the weight % of charged furfuryl alcohol (A) based on the weight of the binder and the weight % of unreacted furfuryl alcohol (B) based on the weight of the binder after the polycondensation is 5.0 to 60.0, and the curing accelerator is contained in an amount of 0.5 to 63.0% by weight.

2. The self-curing binder composition for the production of molds as claimed in claim 1, wherein the binder is a polycondensate comprising as major components furfuryl alcohol, urea, and an aldehyde.

3. The self-curing binder composition for the production of molds as claimed in claim 1, wherein the water content in the binder composition for the production of molds is 6.0% by weight or less.

4. The self-curing binder composition for the production of molds as claimed in claim 1, wherein the nitrogen atom content in the binder composition for the production of molds is 0.5 to 4.0% by weight.

5. A self-curing binder composition for the production of molds comprising a binder obtained by polycondensation of polycondensable components comprising as major components furfuryl alcohol, urea, and an aldehyde, wherein, in the binder contained in the binder composition for the production of molds, the difference between the weight % of charged furfuryl alcohol (A) based on the weight of the binder and the weight % of unreacted furfuryl alcohol (B) based on the weight of the binder after the polycondensation is 5.0 to 60.0, the water content in the binder composition for the production of molds is 6.0% by weight or less, and the nitrogen atom content in the binder composition for the production of molds is 0.5 to 4.0% by weight.

6. A binder/curing agent composition for the production of molds, comprising a curing agent composition having a phosphorus and sulfur atom content wherein the weight ratio of the phosphorus atom and the sulfur atom represented by (the sulfur atom content/(the phosphorus atom content+the sulfur atom content)) is from 0.01 to 7.0; and the binder composition as claimed in any one of claims 1 to 5.

7. A sand composition for the production of molds, comprising a refractory granular material and the self-curing binder composition for the production of molds as claimed in any one of claims 1 to 5.

8. A sand composition for the production of molds, comprising a refractory granular material and the (binder/curing agent for the production of molds) composition as claimed in claim 6.

9. A method for producing a mold, comprising the steps of filling the sand composition for the production of molds as claimed in claim 7 into a prescribed molding block and curing the self-curing binder composition for the production of molds contained in the sand composition for the production of molds.

10. A method for producing a mold, comprising the steps of filling the sand composition for the production of molds as claimed in claim 8 into a prescribed molding block and curing the self-curing binder composition for the production of molds contained in the sand composition for the production of molds.

* * * * *